US006532621B2

(12) United States Patent
Stephens et al.

(10) Patent No.: US 6,532,621 B2
(45) Date of Patent: Mar. 18, 2003

(54) VACUUM CLEANER WITH NOISE SUPPRESSION FEATURES

(75) Inventors: Paul D. Stephens, Twinsburg, OH (US); Jeffrey M. Kalman, Cleveland Heights, OH (US); Steven J. Paliobeis, Painesville, OH (US); Charles J. Thur, Chardon, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 2 days.

(21) Appl. No.: 09/759,437

(22) Filed: Jan. 12, 2001

(65) Prior Publication Data

US 2002/0092123 A1 Jul. 18, 2002

(51) Int. Cl.[7] ..... A47L 9/22
(52) U.S. Cl. ..... 15/412; 15/350
(58) Field of Search ..... 15/412, 350, 351

(56) References Cited

U.S. PATENT DOCUMENTS 3,220,043 A * 11/1965 Lampe ..... 15/340.2
4,376,322 A * 3/1983 Lockhart et al. ..... 15/323
4,517,705 A * 5/1985 Hug ..... 15/351
4,724,574 A * 2/1988 Bowerman et al. ..... 15/351
5,592,716 A * 1/1997 Moren et al. ..... 15/412
5,836,047 A * 11/1998 Lee et al. ..... 15/328
6,003,196 A 12/1999 Wright et al.
6,026,540 A 2/2000 Wright et al.
6,070,291 A 6/2000 Bair et al.
6,289,553 B1 9/2001 Dyson
6,311,366 B1 * 11/2001 Sepke et al. ..... 15/329

* cited by examiner

*Primary Examiner*—Chris K. Moore
(74) *Attorney, Agent, or Firm*—Fay, Sharpe, Fagan, Minnich & McKee, LLP

(57) ABSTRACT

A vacuum cleaner includes a cyclonic airflow chamber that facilitates the separation of contaminants from a suction airstream. The airflow chamber includes a chamber inlet and a chamber outlet, with the chamber inlet being fluidically connected with at least one of a suction nozzle and an above-the-floor cleaning tool. An exhaust filter housing includes a suction duct and an exhaust plenum, with the suction duct communicating with the chamber outlet. A suction source housing includes an open end communicating with the exhaust plenum and a closed end. A suction source is positioned within the suction source housing to define an annular exhaust flow passageway surrounding the suction source from the housing closed end to the housing open end. The suction source includes a suction inlet communicating with the suction duct and an exhaust outlet communicating with the housing closed end.

21 Claims, 8 Drawing Sheets

VACUUM CLEANER WITH NOISE SUPPRESSION FEATURES

BACKGROUND OF THE INVENTION

This invention relates to vacuum cleaners. More particularly, it relates to a vacuum cleaner that provides increased suction power while reducing undesirable noise that is generated during operation of the vacuum cleaner.

It is considered desirable to provide vacuum cleaners with strong suction power. However, increasing the suction power of a vacuum cleaner generally results in increasing the level of noise that is generated by the vacuum cleaner during cleaning operations.

Accordingly, it is considered desirable to develop a new and improved vacuum cleaner with strong suction power and noise suppression features that meets the above-stated needs and overcomes the foregoing difficulties and others while providing better and more advantageous results.

BRIEF SUMMARY OF THE INVENTION

One aspect of the present invention relates to a vacuum cleaner motor housing.

More particularly in accordance with this aspect of the invention, the vacuum cleaner motor housing includes an outer wall defining a motor housing cavity with an open end and a closed end; and a motor/fan assembly positioned within the cavity, the motor/fan assembly including a motor having an output shaft, a fan casing secured to the motor and having an inlet aperture, and an impeller rotatably secured to the motor output shaft within the fan casing, wherein the motor is positioned proximate the cavity closed end, the fan casing is positioned proximate the cavity open end, and the motor output shaft extends parallel to a central longitudinal axis of an associated vacuum cleaner upper assembly.

In accordance with another aspect of the invention, vacuum cleaner is provided. More particularly, in accordance with this aspect of the invention, the vacuum cleaner includes a separation chamber that facilitates the separation of debris from a suction airstream; an exhaust filter housing including a central suction duct, an exhaust filter, and an exhaust passageway defined between the central suction duct and the exhaust plenum; and a motor housing including a motor/fan assembly positioned therein; wherein an airflow pathway extends i) in a first direction from the separation chamber through the central suction duct and the motor/fan assembly and into the motor housing, ii) in a second direction opposite to the first direction through an annular passageway surrounding the motor/fan assembly and into the exhaust plenum, and iii) in a third direction transverse to the first and second directions through the exhaust filter.

More particularly in accordance with another aspect of the invention, the vacuum cleaner includes a cyclonic airflow chamber that facilitates the separation of contaminants from a suction airstream, the airflow chamber including a chamber inlet and a chamber outlet, the chamber inlet being fluidically connected with at least one of a suction nozzle and an above-the-floor cleaning tool; an exhaust filter housing including a suction duct and an exhaust plenum, the suction duct communicating with the chamber outlet; a suction source housing including an open end communicating with the exhaust plenum and a closed end; and a suction source positioned within the suction source housing to define an annular exhaust flow passageway surrounding the suction source from the housing closed end to the housing open end, the suction source including a suction inlet communicating with the suction duct and an exhaust outlet communicating with the housing closed end.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
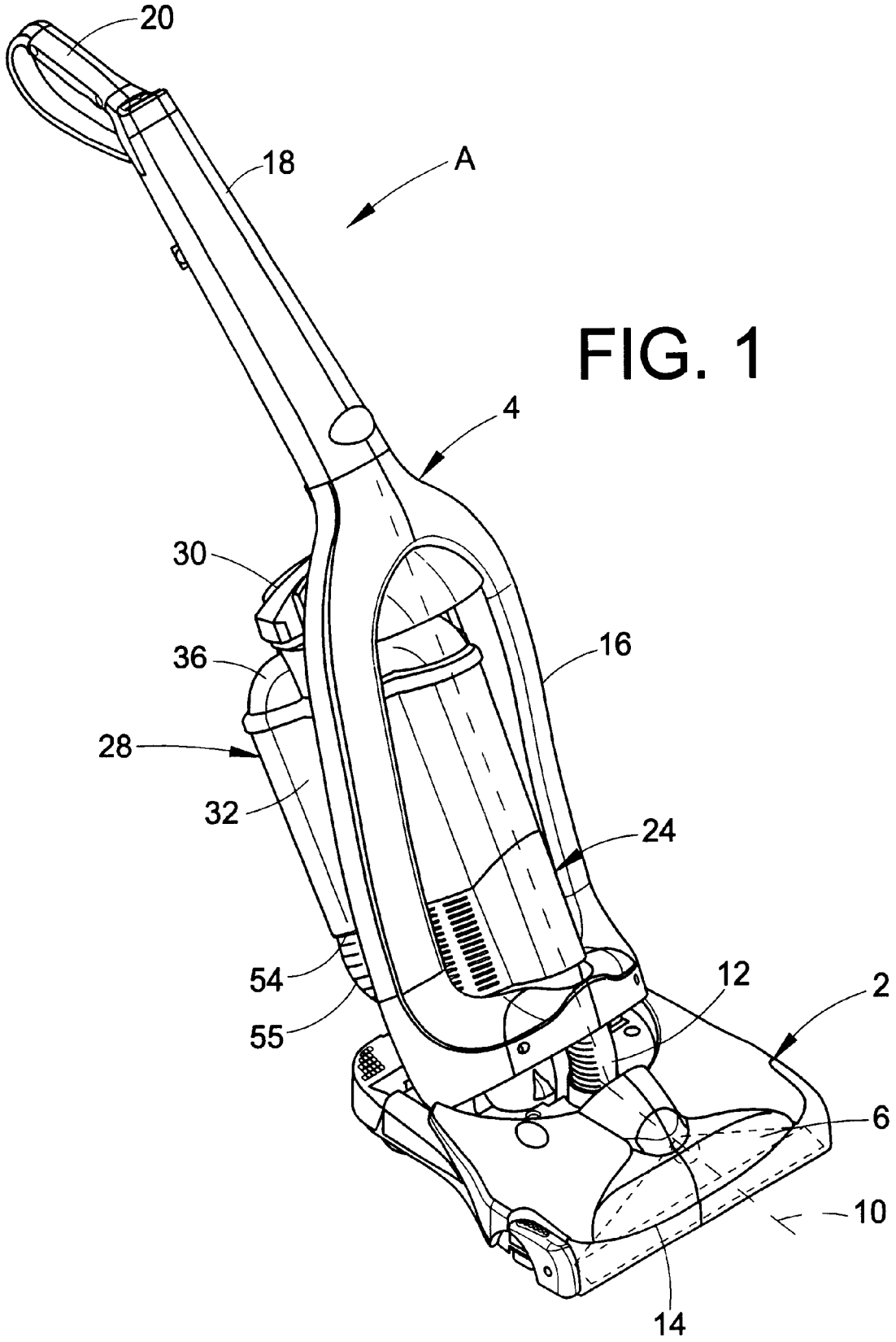
FIG. 1 is a perspective view from the front left of a vacuum cleaner according to the present invention.

Referring now to the drawings, wherein the showings are for purposes of illustrating a preferred embodiment of the invention only and not for purposes of limiting same, there is shown a particular type of upright vacuum cleaner in which the subject noise suppression features are embodied. While the noise suppression features can be employed in this type of vacuum cleaner, it should be appreciated that it can be used in other types of vacuum cleaners as well.

Figure 5:
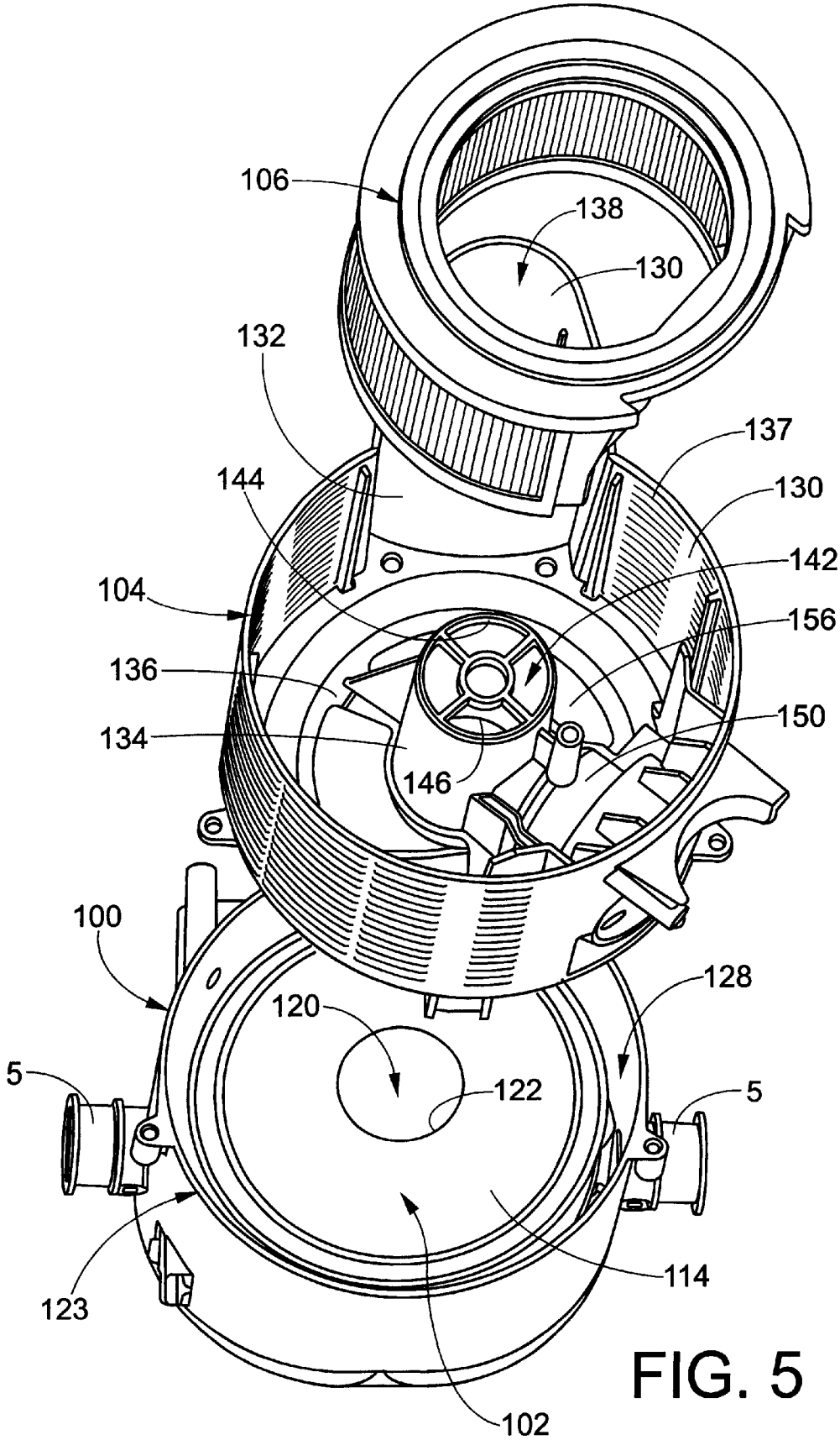
FIG. 5 is an exploded perspective view from the rear of the motor/final filter assembly of FIG. 4.

More particularly, FIG. 1 illustrates a vacuum cleaner A including a wheeled floor nozzle or nozzle base 2 and an upper assembly 4. The nozzle base 2 and the upper assembly are preferably formed from conventional materials such as molded plastics and the like. As best shown in FIG. 5, the upper assembly 4 is pivotally secured to the nozzle base 2 via trunnions 5 only is shown associated with a filter housing 100. Referring again to FIG. 1, the nozzle base 2 includes a downwardly opening brushroll chamber or cavity 6 (shown in phantom) that extends laterally along a front portion of the nozzle base. The brushroll chamber 6 is adapted to receive and rotatably support a driven agitator or brushroll (not shown). An aperture 8 extends through a rear wall of the brushroll chamber 6. The aperture 8 is substantially centered between two side walls that partially define the brushroll chamber 6. Thus, the aperture 8 is substantially centered on a center line 10 of the vacuum cleaner A.

A discharge duct 12, such as a conventional flexible, expandable, helical wire-type hose, communicates with and extends rearwardly from the aperture 8. The duct 12 provides a pathway for suction air that is drawn by a source of suction power (e.g. a fan/motor assembly 102) through the brushroll chamber 6 from a nozzle inlet 14 associated with the brushroll chamber 6. It should be appreciated that, with the aperture 8 substantially centered along the vacuum cleaner center line 10, a substantially even (i.e. symmetrical) amount of suction air flow can be drawn from each side of the nozzle inlet 14.

Figure 2:
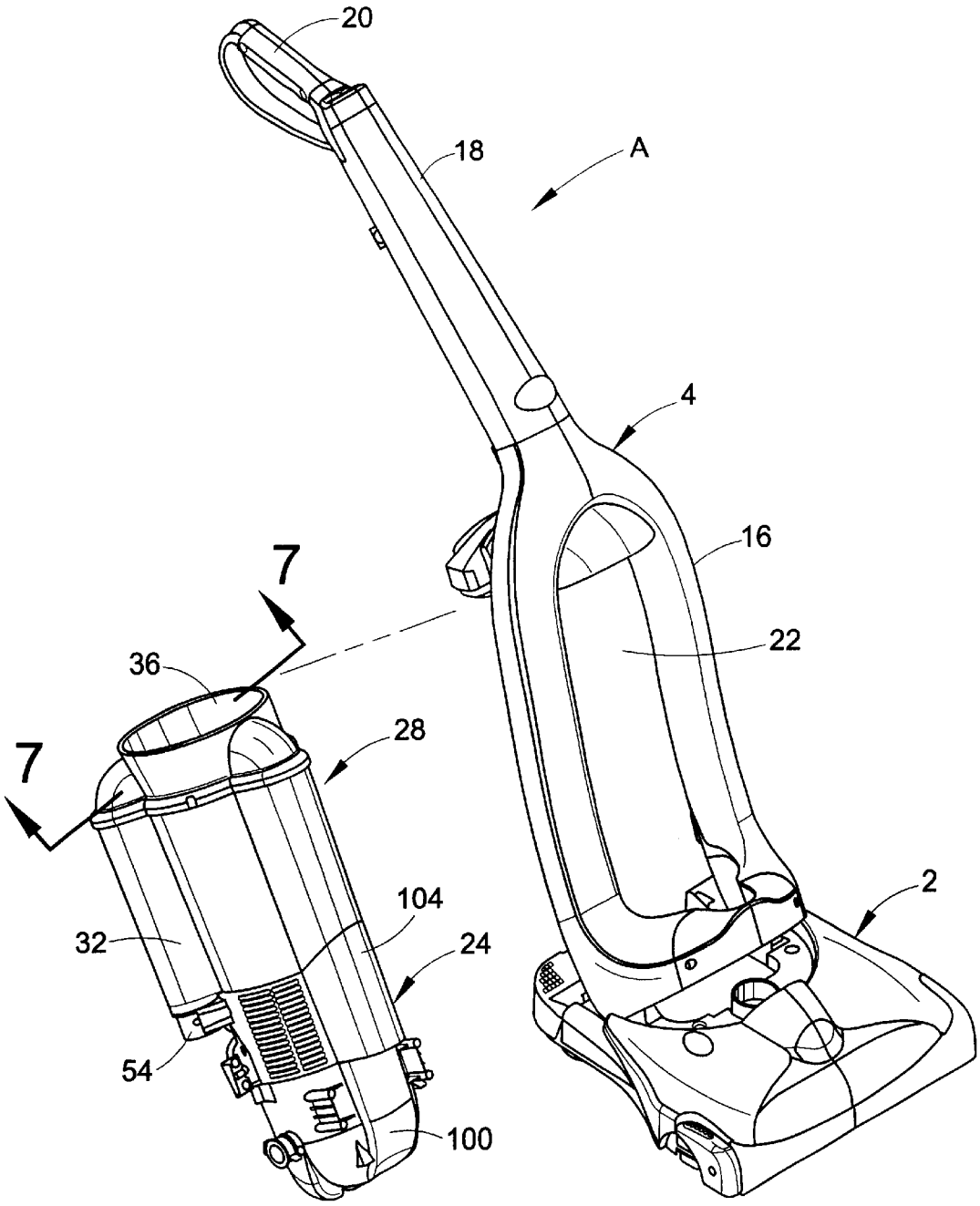
FIG. 2 is an exploded perspective view of the vacuum cleaner of FIG. 1.

The vacuum cleaner upper assembly 4 includes a lower handle portion 16, an upper handle portion 18 and a hand grip 20. As best illustrated in FIG. 2, the lower handle portion 16 is generally wishbone or U-shaped, and includes a pair of legs which define between them an opening 22. A motor/final filter assembly 24 is positioned within the opening 22, and is fixedly secured to the lower handle portion 16. A dirt cup assembly 28 is positioned within the opening 22 above the motor/final filter assembly 24, and is removably secured to the upper assembly 4.

A cap 30 is pivotally mounted to the lower handle portion 16 above the dirt cup assembly 28. The cap 30 defines a portion of a latch assembly that cooperates with a catch frame (not shown) to removably secure the dirt cup assembly 28 to the upper assembly 4, as described and illustrated in the Assignee's copending U.S. patent application Ser. No. 09/758,725, the disclosure of which is hereby incorporated by reference. Further, the cap 30 includes at least one indentation on an upper surface thereof, which indentation is shaped to accommodate an associated cleaning tool of the vacuum cleaner.

Figure 3:
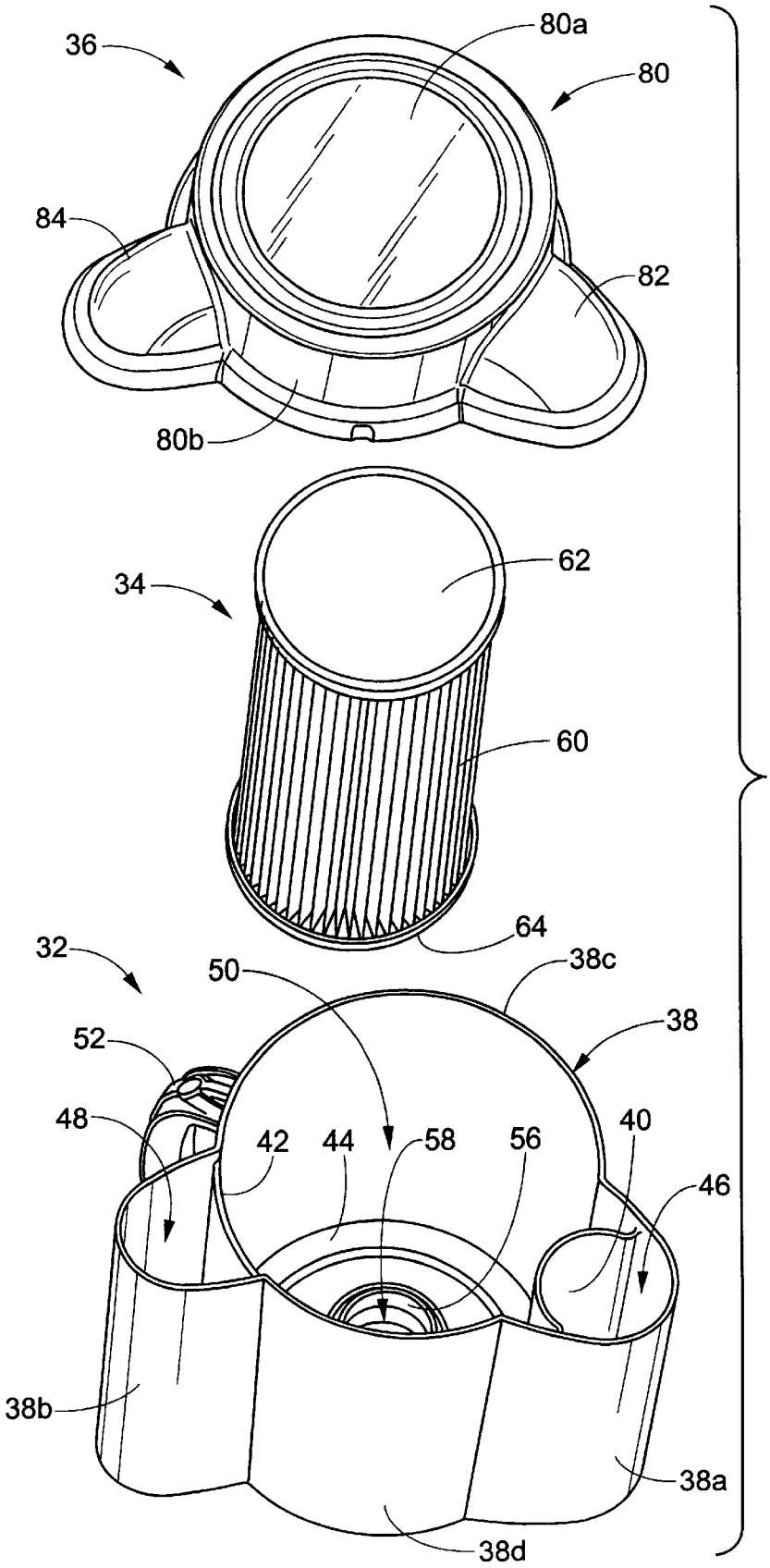
FIG. 3 is an exploded perspective view of a dirt cup assembly of the vacuum cleaner of FIG. 1.

Referring now to FIG. 3, the dirt cup assembly 28 includes a dirt cup 32, a primary, main, or first-stage filter assembly 34 removably positioned within the dirt cup 32, and a lid 36 removably covering an open upper end of the dirt cup 32. While the preferred embodiment of the lid 36 is described and illustrated as being removable from the vacuum cleaner A along with the remainder of the dirt cup assembly 28, it is contemplated that the lid 36 can alternatively be fixed, secured, or formed integral with the vacuum cleaner upper assembly 4 (such as cap 30) so that only the dirt cup 32 and depending filter assembly 34 would be removable from the vacuum cleaner.

The dirt cup 32 is formed from an outer wall 38, a first inner wall 40, a second inner wall 42, and a bottom wall 44 joined to or formed integral with the lower end edges of the walls 38–42. A first U-shaped or enlarged portion 38*a* of the outer wall 38 cooperates with the first inner wall 40 to define a forward dirty-air conduit or inlet duct 46. Likewise, a second U-shaped or enlarged portion 38*b* of the outer wall 38 cooperates with the second inner wall 42 to define a rear dirty-air conduit or inlet duct 48. The first inlet duct 46 is circumferentially spaced from the second inlet duct by about 120°. The remaining portions 38*c*, 38*d* of the outer wall 38 cooperate with both inner walls 40, 42 to define a dust/debris collection or separation chamber 50. A handle 52 extends from the outer wall 38 at a position substantially opposite (i.e. about 180°) from the inlet duct 46. 10 Each inlet duct 46, 48 includes a respective aperture through the dirt cup bottom wall 44. When the dirt cup assembly 28 is mounted to the vacuum cleaner, the forward inlet duct 46 is in fluid communication with the brushroll chamber 6 through the flexible hose 12. As described further below, the flexible hose 12 extends from the nozzle base 2 to an upper extent of a passageway 138 associated with a final filter housing 104. As best shown in FIG. 1, when the dirt cup assembly 28 is mounted to the vacuum cleaner, the dirt cup rear inlet duct 48 is in fluid communication with an above-the-floor cleaning wand through a connector 54 associated with the final filter housing 104 and a depending flexible hose 55 connected thereto.

It should be appreciated that, with the dirt cup assembly 28 mounted to the vacuum cleaner, the dirt cup inlet duct 46 is positioned forward of the lower handle portion 16, and the dirt cup inlet duct 48 is positioned rearward of the lower handle portion 16. This, in effect, minimizes the lengths of the dirty airflow pathways between the dust collection chamber 50 and the brushroll chamber 6, and between the dust collection chamber 50 and an above-the-floor cleaning tool, respectively.

A filter support 56 such as a post, stem, boss, hub, or like structure is formed integral with and projects upward from the dirt cup bottom wall 44. The filter support 56 is centrally positioned within in the dust collection chamber 50 and includes an exhaust or outlet passage 58 through the bottom wall 44 and centered on a central longitudinal axis 110 (FIG. 4) through the dirt cup 32. As described further below with regard to FIG. 4, the dirt cup exhaust passage 58 communicates with a corresponding central suction passage or duct 142 of the final filter housing 104 when the dirt cup assembly 28 is attached to the vacuum cleaner.

With continued reference to FIG. 3, the primary filter assembly 34 includes a filter medium 60, filter cap 62, and filter ring 64. The filter cap 62 and filter ring 64 are preferably formed from molded plastic. The filter medium 60 is shaped into a hollow, tubular, cylindrical form from a planar, pleated filter membrane.

Figure 7:
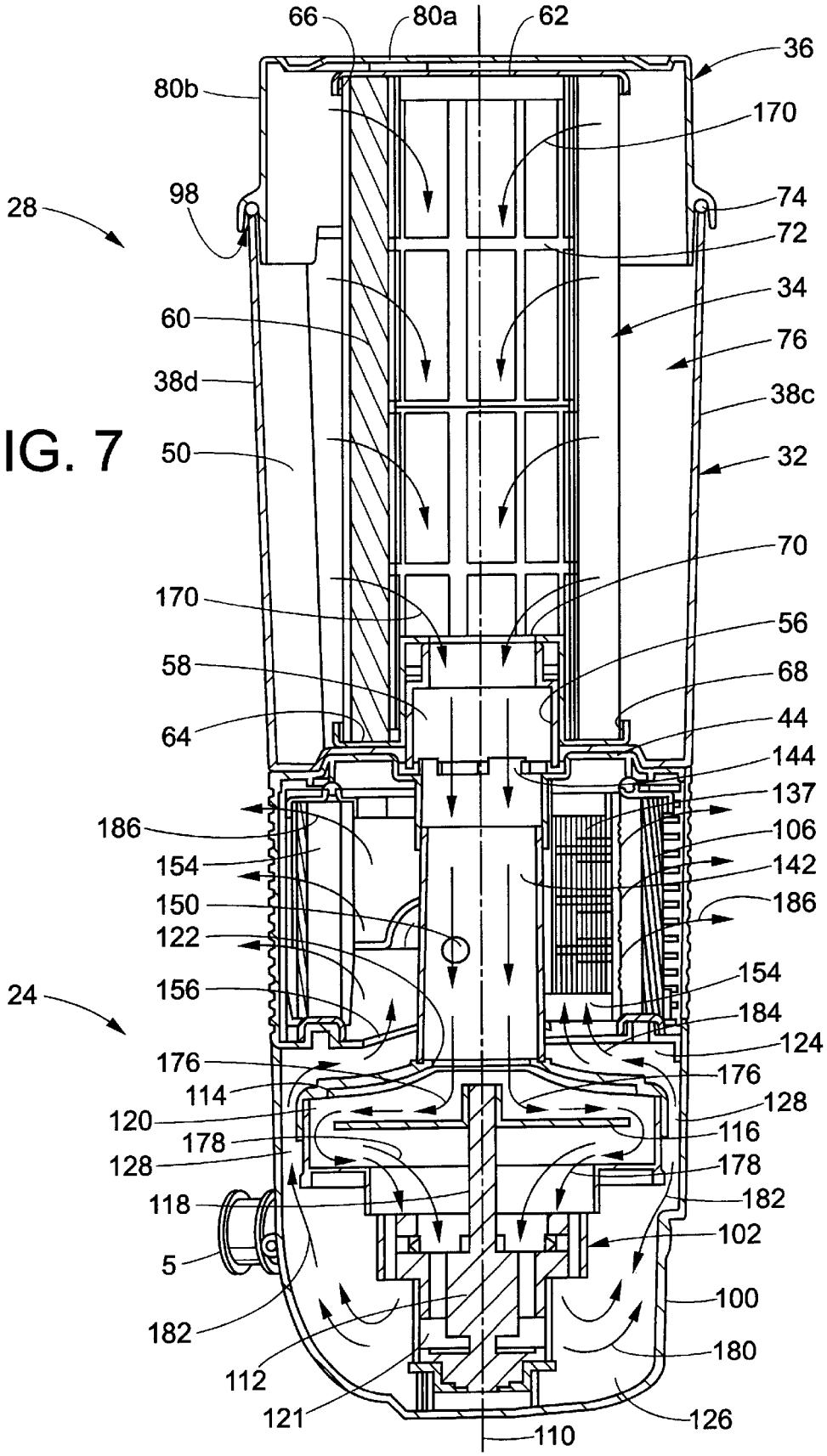
FIG. 7 is a cross section view through the dirt cup and motor/final filter assemblies of FIG. 2, taken along the line 7—7.

As best shown in FIG. 7, an upper end of the pleated membrane 60 is seated in an annular groove 66 of the filter cap 62. Likewise, a lower end of the pleated filter membrane 60 is seated in an annular groove 68 of the filter ring 64. The filter ring 64 further includes an aperture 70 that communicates with the dirt cup outlet passage 58 when the filter assembly 34 is operatively positioned within the dirt cup 32. The pleated filter membrane 60 is internally supported on an open frame structure 72 that extends axially between the filter cap 62 and filter ring 64. The open frame structure 72 does not impede airflow through the pleated filter element 60, but ensures that the filter element will not collapse under the force of a suction airstream.

When the main filter assembly 34 is positioned over the filter support 56, the main filter assembly 34 extends upward from the bottom wall 44 to a level that is above an upper edge 74 of the dirt cup 32. In addition, the lower filter ring 64 engages the filter support 56 with an interference fit so that the filter assembly 34 is releasably, yet securely, retained in its operative position as shown, even when the dirt cup 32 is removed from the vacuum cleaner and inverted for purposes of emptying the contents thereof. Moreover, an annular cyclonic airflow passage 76 is defined in the dust collection chamber 50 between the main filter assembly 34 and the surrounding portion of the dirt cup 32 over the entire height of the dirt cup assembly 28 when the filter assembly 34 operatively positioned within the dirt cup.

A preferred medium for the filter membrane 60 comprises polytetrafluoroethylene (PTFE), a polymeric, plastic material commonly referred to by the registered trademark TEFLON®. The low coefficient of friction of a filter medium comprising PTFE facilitates cleaning of the filter element by washing. Most preferably, the pleated filter medium 60 is defined substantially or entirely from GORE-TEX®, a PTFE-based material commercially available from W. L. GORE & ASSOCIATES, Elkton, Md. 21921. The preferred GORE-TEX® filter medium, also sold under the trademark CLEANSTREAM® by W. L. GORE & ASSOCIATES, is an expanded PTFE membrane defined from billions of continuous, tiny fibrils. The filter blocks the passage of at least 99% of particles 0.3 $\mu$m in size or larger. Although not visible in the drawings, the inwardly and/or outwardly facing surface of the CLEANSTREAM® filter membrane 60 can be coated with a mesh backing material of plastic or the like for durability since it enhances the abrasion-resistance characteristics of the plastic filter material. The mesh may also enhance the strength of the plastic filter material somewhat.

Alternatively, the filter element 60 can comprise POREX® brand, high-density polyethylene-based, open-celled, porous media available commercially from Porex Technologies Corp. of Fairburn, Ga. 30212, or an equivalent foraminous filter media. This preferred filter media is a rigid open-celled foam that is moldable, machinable, and otherwise workable into any shape as deemed advantageous for a particular application. The preferred filter media has an average pore size in the range of 45 $\mu$m to 90 $\mu$m. It can have a substantially cylindrical configuration, or any other suitable desired configuration. The filter element can also have a convoluted outer surface to provide a larger filtering area. It should be appreciated that some filtration is also performed by any dirt or debris that accumulates in the bottom the dirt cup.

Referring again to FIG. 3, the lid 36 includes a generally-cylindrical center portion 80 having a planar upper wall 80*a* and a cylindrical side wall 80*b*. The lid 36 further includes first and second sloped wall portions 82, 84, each of which extends radially outward from the cylindrical side wall 80*b*. Thus, the dirt cup lid 36 is shaped to engage with the corresponding dirt cup 32. In particular, the center portion 80 extends over the dirt cup dust collection chamber 50, the sloped wall portion 82 extends over the dirt cup forward inlet duct 46, and the sloped wall portion 84 extends over the dirt cup rear inlet duct 48.

Figure 3A:
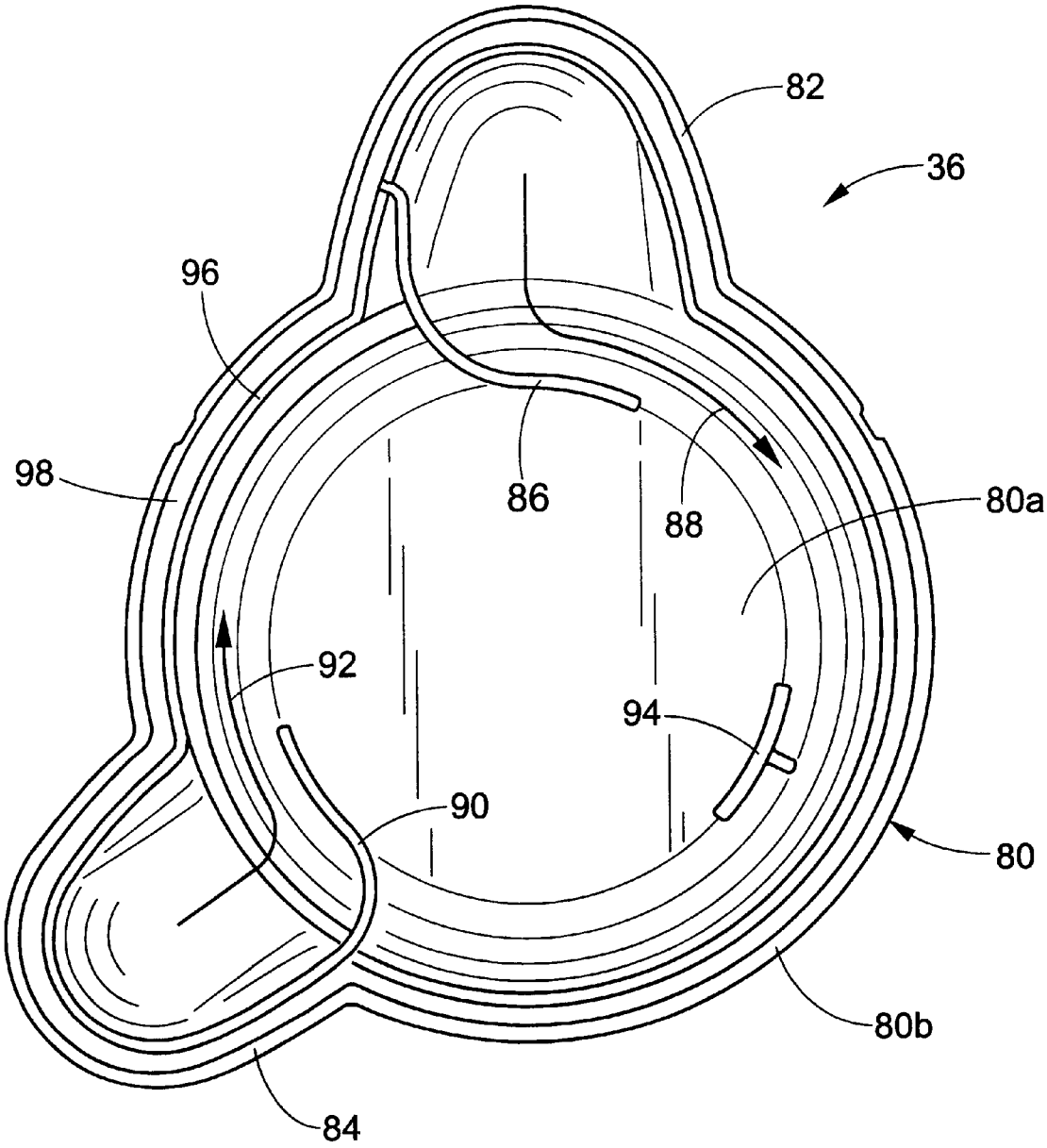
FIG. 3*a* is a bottom plan view of a lid associated with the dirt cup assembly of FIG. 3.

Referring now to FIG. 3*a*, an angled diverter wall 86, joined to at least the inner surface of upper wall 80*a* and extending downward to at least the lowermost extent of sloped wall portion 82, is positioned to divert an airflow from the dirt cup inlet duct 46 and sloped wall portion 82 from a radial path to a tangential path (relative to the filter assembly 34) within the annular cyclonic airflow passage 76 as shown by arrow 88. Likewise, a second angled diverter wall 90, also joined to at least the inner surface of upper wall 80*a* and extending downward to at least the lowermost extent of sloped wall portion 84, is positioned to divert an airflow from the dirt cup inlet duct 48 and sloped wall portion 84 from a radial path to a tangential path (relative to the filter assembly 34) within the annular cyclonic airflow passage 76 as shown by arrow 92.

The orientation of the diverter walls 86, 90 will affect the direction of cyclonic airflow within the passage 76, and the invention is not meant to be limited to a particular direction, i.e. clockwise or counterclockwise.

With continued reference to FIG. 3*a*, the diverter walls 86, 90 and an arcuate rib 94, which rib extends slightly from the inner surface of the lid upper wall 80*a*, engage an outer surface of the filter cap 62 to facilitate centering the filter assembly 34 within the dust collection chamber 50. Lastly, an inner rib 96 is spaced inward from lowermost extent of the cylindrical side wall 80*a* and the sloped wall portions 82, 84 to define a channel 98 around the periphery of the lid 36, which channel constrains or otherwise accommodates the upper edge 74 of the dirt cup 32 when the lid 36 covers the dirt cup.

It should be appreciated that, if necessary or desired, the filter cap 62 can be provided with a gasket on an upper surface thereof so that when the filter assembly 34 is operatively mounted within the dirt cup 32 and the lid 36 is covering the dirt cup, the gasket would mate in a fluid-tight manner with the inner surface of the lid upper wall 80*a* to prevent undesired airflow through an axial space between the lid 36 and filter assembly 34. For convenience, the filter cap 62 can be replaced with a second filter ring so that either end of the filter assembly 34 could be mounted to the filter support 56 of the dirt cup 32. In this case, both filter rings could be formed from a compressible, gasket material, or a separate gasket could be mounted to each filter ring, or a gasket could be secured to the lower surface of the lid upper wall 80*a*.

Figure 4:
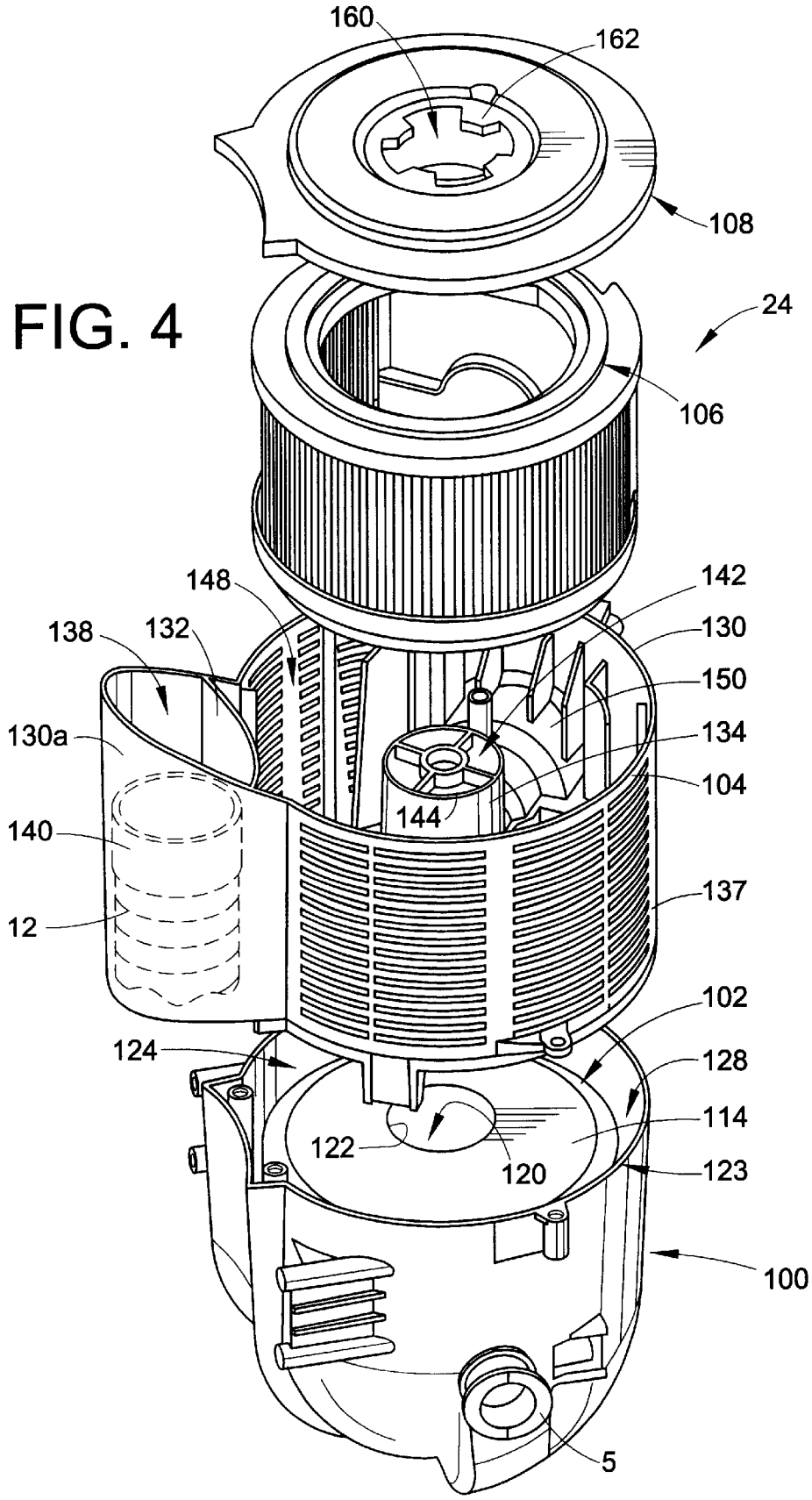
FIG. 4 is an exploded perspective view from the right of a motor/final filter assembly of the vacuum cleaner of FIG. 1.

Referring now to FIG. 4, the motor/final filter assembly 24 includes a motor housing 100, a motor/fan assembly 102 mounted upright within the motor housing 100, a final filter housing 104 positioned above and mounted to the motor housing 100, a final filter or exhaust filter 106 removably positioned within the filter housing 104, and a filter housing lid 108 removably covering the filter housing 104.

As best shown in FIG. 7, the motor/fan assembly 102 includes an electric motor and casing 112, a fan casing 114 fixedly secured to the motor and casing 112, and a fan or impeller 116 rotatably secured to a motor output shaft 118 within an impeller cavity 120 defined by the fan casing 114. The fan casing 114 further includes an upper inlet aperture 122 that communicates with an upper extent of the impeller cavity 120. The motor and casing 112 includes a lower exhaust outlet 121.

Figure 6:
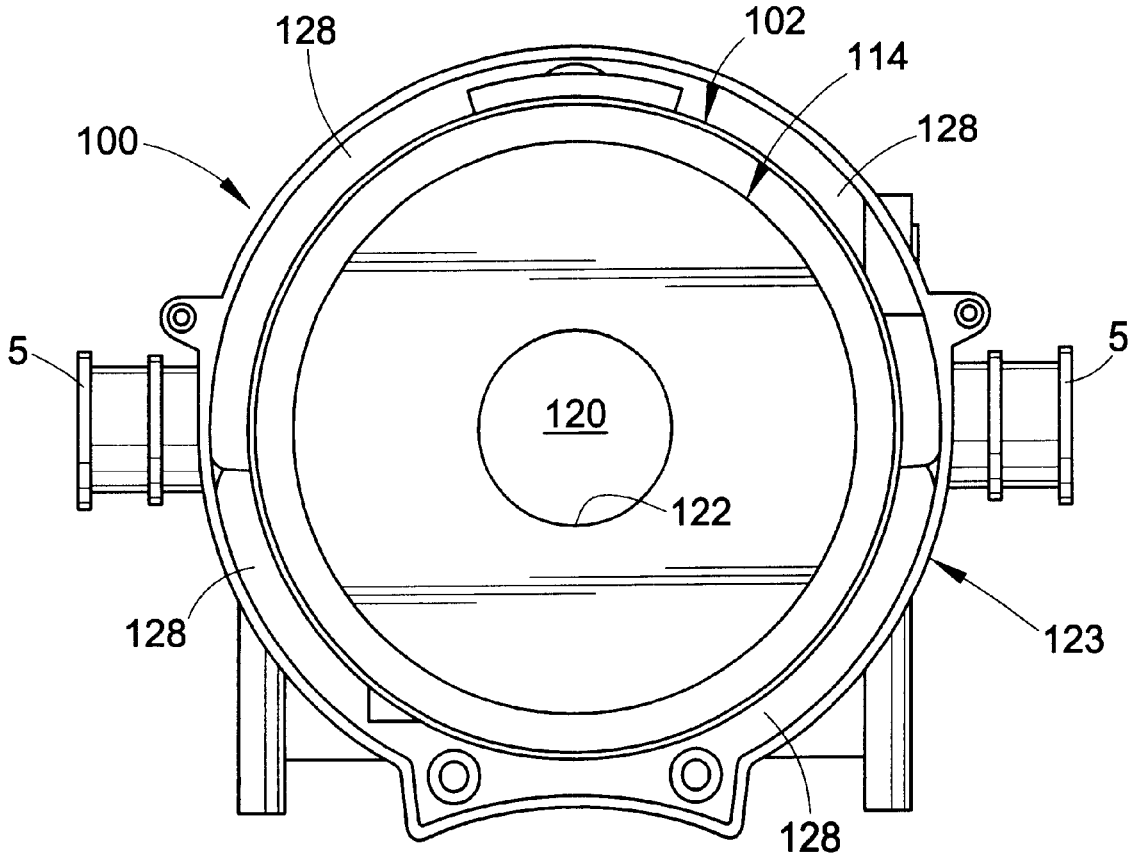
FIG. 6 is a top view of a motor housing of the motor/final filter assembly of FIG. 4.

The motor housing 100 is formed from a generally cylindrical outer or side wall 123 that defines a housing cavity with an open upper end 124 and a closed lower end 126. The motor/fan assembly 102 is mounted upright within the housing cavity such that the motor output shaft 118 extends generally parallel to the central longitudinal axis 110. As best shown in FIG. 6, an annular exhaust flow pathway 128 is defined between the motor housing outer wall 123 and the motor/fan assembly 102.

Referring again to FIG. 4, the final filter housing 104 is formed from a generally cylindrical outer side wall 130, an arcuate inner wall 132, a tubular center wall 134, and a generally circular bottom wall 136 (FIG. 5). A series of vents or exhaust apertures 137 extend through the housing outer wall 130 to vent exhaust airflow from the final filter 106 as described further below. A U-shaped or enlarged portion 130a of the outer wall 130 cooperates with the inner wall 132 to define the forward hose passageway 138 that accommodates the expandable hose 12. An upper extent of the hose 12 engages (e.g. threadably, frictionally, adhesively) with a connector arrangement 140 within the passageway 138. With the dirt cup assembly 28 mounted to the vacuum cleaner, the dirt cup forward inlet duct 46 contacts an upper surface of the passageway 138 in a fluid-tight manner to communicate with the brushroll chamber 6 through a portion of the passageway 138 and hose 12.

The filter housing center wall 134 defines the central suction duct 142 that extends axially through the housing 104. An upper extent of the airflow duct 142 defines an inlet aperture 144 that communicates with the dirt cup exhaust passage 54 in a fluid-tight manner when the dirt cup assembly 28 is mounted to the vacuum cleaner. As best shown in FIG. 5, a lower extent of the central suction duct 142 defines an outlet aperture 146 that communicates with the fan casing aperture 122 in a fluid-tight manner.

It is contemplated that a disk-type secondary or intermediate filter can be positioned within or proximate the inlet aperture 144 to prevent dirt and debris from reaching the motor/fan assembly 102 in the event that the filter assembly 34 fails in any manner. That is, should there be a leak in the filter assembly 34, the secondary filter would prevent dirt from being drawn into the motor/fan assembly. The disk-type filter can be formed from a conventional open-celled foam or sponge material.

With continued reference to FIGS. 4 and 5, the filter housing side wall 130 and inner walls 132, 134 cooperate to define a substantially annular filter chamber or cavity 148 that accommodates the final filter 106. An open bleed-air port 150 extends radially through the annular filter cavity 148 between the outer wall 130 and the inner wall 134. The bleed air port 150 provides a secondary suction airflow pathway into the motor/fan assembly 102 in the event that suction airflow from the dirt cup assembly 28 is restricted or otherwise blocked. That is, the bleed air port 150 provides a secondary source of cooling air to prevent the motor 112 from overheating and potentially failing in the event that suction airflow from the dirt cup assembly 28 is restricted or blocked.

Referring again to FIG. 7, an annular exhaust plenum 154 is defined in the filter cavity 148 between the final filter 106 and the filter housing center wall 134 over the entire height of the filter housing 104 when the final filter 106 is operatively positioned within the filter cavity 148. Referring again to FIG. 5, the filter housing bottom wall 136 includes at least one (and preferably two or more) arcuate, semi-circular, or crescent-shaped exhaust inlet apertures 156 that permit the open upper end 124 of the motor housing 100 to communicate with exhaust plenum 154.

The final-stage exhaust filter medium 106 is preferably formed from a pleated, high-efficiency particulate arrest (HEPA) filter element that is bent, folded, molded, or otherwise formed into a generally annular or arcuate C-shape. As such, those skilled in the art will recognize that even if the motor/fan assembly causes contaminants to be introduced into the suction airstream downstream from the main filter assembly 34, the final filter 106 will remove the same such that only contaminant-free air is discharged into the atmosphere.

As shown in FIG. 4, the filter lid 108 is substantially planar and covers an open upper end of the filter cavity 148 when the positioned over the filter housing 104. A center aperture 160 and associated gasket 162 of the lid 108 permit the dirt cup outlet passage 58 to communicate with the filter housing central suction duct 142 in a fluid-tight manner.

It should be appreciated that, if necessary or desired, the final filter 106 can be provided with a gasket on the upper and lower annular surfaces thereof so that when the filter assembly 106 is operatively mounted within the filter cavity 148 and the lid 108 is covering the filter housing 104, the upper gasket would mate in a fluid-tight manner with the inner surface of the lid 108 to prevent undesired airflow through an axial space between the lid 108 and filter assembly 106. Further, the lower gasket would ate in a fluid-tight manner with the filter housing bottom wall 136 to prevent undesired airflow through an axial space between the filter element 106 and the bottom wall 136.

During on-the-floor cleaning operations utilizing the nozzle base 2, dirty airflow is drawn by the motor/fan assembly 102 along a substantially straight, and hence, short, path from the brushroll chamber aperture 6, through the discharge duct 12 and upper portion of passageway 138, through the dirt cup inlet duct 46, and into the dirt cup cyclonic airflow passage 76. It should be appreciated that, by positioning the dirt cup inlet duct 46 along the vacuum cleaner center line 10 and forward of the lower handle portion 16, the length of the dirty airflow path from the brushroll chamber 6 to the dirt cup dust collection chamber 50 can be minimized thus providing increased suction power in the brushroll chamber 6. In other words the length of the dirty airflow path from the brushroll chamber 6 to the dirt cup dust collection chamber 50 can be minimized by positioning the whole dirty airflow path forward of a pivot axis of the upper assembly 4.

The dirty air flow drawn from the inlet duct 46 into the cyclonic passage 76 is diverted by diverter 86, as illustrated by arrow 88. This causes a cyclonic or vortex-type flow that spirals downward in the passage 76 since the top end thereof is blocked by the lid 36. As best shown in FIG. 7, this cyclonic action separates a substantial portion of the entrained dust and dirt from the suction airstream and causes the dust and dirt to be deposited in the dirt cup 32 when the dirty airflow is eventually drawn radially inward through the filter membrane 60 and then axially downward through the hollow interior of the filter assembly 34 (arrows 170). The filtered airflow is then drawn axially through the dirt cup outlet passage 58 (arrows 172), axially through the filter housing suction duct 142 (arrows 174) and into the impeller cavity 120 through inlet aperture 122 (arrows 176).

The rotating impeller 116 generates an exhaust airflow from the filtered air drawn into the impeller cavity 120. The exhaust airflow (arrows 178) is forced through the electric motor casing and across the electric motor windings thereby cooling the motor 112. The exhaust airflow is discharged from the motor casing into the closed lower end 126 of the motor housing 100 (arrows 180), upward through the annular exhaust passageway 128 (arrows 182) surrounding the motor/fan assembly 102, through the exhaust inlet apertures 156 of the filter housing and into the filter housing exhaust plenum 154 (arrows 184). Thereafter, the exhausted airstream then flows laterally or radially outward from the plenum 154 and through the final filter 106 (arrows 186).

Generally speaking, the more turns, bends, or twists that a suction airstream makes through a given airflow pathway, the less noise that is generated by the suction airstream. Thus, it should be appreciated that the tortuous airflow pathway from the impeller cavity aperture 122, around the impeller 116 and down through the motor casing 112, back up through motor housing 100 and exhaust plenum 154, and radially outward through the final filter 106 and filter housing vents 137, serves to reduce the noise generated by the suction airflow relative to less tortuous airflow pathways found in the prior art. Additionally, it is contemplated that the motor housing components such as the inner surface of the motor housing side wall, the stationary impeller casing, etc. can be coated or otherwise provided with a noise damping material to further reduce or otherwise suppress the noise generated by the suction airstream through the vacuum cleaner.

During above-the-floor cleaning operations, dirty air flows from a cleaning tool/wand arrangement and depending hose 55, through the dirt cup inlet duct 48, and into the dirt cup cyclonic airflow passage 76 As mentioned above, positioning the dirt cup inlet duct 48 slightly rearward of the lower handle portion 16 minimizes the length of the dirty airflow path from an above-the-floor cleaning tool to the dirt cup dust collection chamber 50 to provide increased suction power at the cleaning tool. As with an on-the-floor cleaning operation, dirty air flow from the inlet duct 48 into the cyclonic passage 76 is diverted by diverter 90, as illustrated by arrow 92. This causes a cyclonic or vortex-type airflow that follows the same pathway through the dirt cup 32, filter housing 104 and motor housing 100 as described above.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described a preferred embodiment(s) of invention, what is claimed is:

1. A vacuum cleaner motor housing comprising:

an outer wall defining a motor housing cavity with an open end and a closed end; and a motor/fan assembly positioned within the cavity, the motor/fan assembly including a motor having an output shaft, a fan casing secured to the motor and having an inlet aperture, and an impeller rotatably secured to the motor output shaft within the fan casing, wherein the motor is positioned proximate the cavity closed end, the fan casing is positioned proximate the cavity open end, wherein an airflow pathway extends generally in a first direction from the fan casing inlet through the motor/fan assembly and into the cavity closed end, and then generally in a second direction opposite to the first direction from the cavity closed end through an annular passageway around the motor/fan assembly and through the cavity open end.

2. The motor housing of claim 1, wherein the outer wall includes a plurality of trunnions that pivotally mount the motor housing to an associated vacuum cleaner nozzle base.

3. The motor housing of claim 2, wherein said motor output shaft extends generally perpendicular to a pivot axis of said motor housing extending through the plurality of trunnions.

4. The motor housing of claim 1, wherein said motor housing outer wall comprises a side wall which is generally cylindrical in shape.

5. The motor housing of claim 1, wherein said motor/fan assembly is mounted in an upright orientation within the housing cavity.

6. The motor housing of claim 1 wherein the portion of the airflow pathway extending generally in the first direction is located radially inwardly of the portion of the airflow pathway extending generally in the second direction.

7. A vacuum cleaner motor housing comprising:

an outer wall defining a motor housing cavity with an open end and a closed end; and a motor/fan assembly positioned within the cavity, a fan casing secured to a motor of the motor/fan assembly and having an inlet, wherein an airflow pathway extends generally in a first direction from the fan casing inlet through the motor/fan assembly and towards the cavity closed end, and then generally in a second direction opposite to the first direction away from the cavity closed end through an annular passageway around the motor/fan assembly and through the cavity open end.

8. The motor housing of claim 7, wherein the outer wall includes a plurality of trunnions that pivotally mount the motor housing to an associated vacuum cleaner nozzle base.

9. The motor housing of claim 7, further comprising a motor output shaft which extends generally perpendicular to a pivot axis of said motor housing.

10. The motor housing of claim 7, wherein said motor housing outer wall comprises a side wall which is generally cylindrical in shape.

11. The motor housing of claim 7, wherein said motor/fan assembly is mounted in an upright orientation within the housing cavity.

12. The motor housing of claim 7 wherein the portion of the airflow pathway extending generally in the first direction is located radially inwardly of the portion of the airflow pathway extending generally in the second direction.

13. A vacuum cleaner motor housing comprising:

a side wall and an end wall defining a motor housing cavity with an open end and a closed end;

a motor/fan assembly mounted in said motor housing cavity such that a motor of said motor/fan assembly is positioned adjacent said closed end of said cavity and a fan of said motor/fan assembly is positioned adjacent said open end of said cavity; and an airflow pathway located in said motor housing cavity, said airflow pathway comprising:

a first portion extending generally in a first direction toward said cavity closed end, and a second portion extending generally in a second direction away from said cavity closed end and through an annular passageway around said motor/fan assembly and through said cavity open end.

14. The motor housing of claim 13 wherein said motor comprises an output shaft extending toward said cavity open end.

15. The motor housing of claim 14 wherein said fan is mounted on said output shaft.

16. The motor housing of claim 15 wherein an inlet of said fan is aligned with said motor output shaft.

17. The motor housing of claim 13 further comprising a pair of opposed trunnions extending away from said side wall for pivotally mounting the motor housing to an associated vacuum cleaner nozzle base.

18. The motor housing of claim 13 wherein said first portion of said airflow pathway is located radially inwardly of said second portion thereof.

19. The motor housing of claim 18 wherein an inlet of said first portion is aligned with an output shaft of said motor.

20. The motor housing of claim 13 wherein said second portion of said airflow pathway is defined between said motor/fan assembly and said side wall.

21. The motor housing of claim 13 wherein said side wall is generally cylindrical in shape.

* * * * *